United States Patent [19]

Bannister

[11] Patent Number: 4,911,355

[45] Date of Patent: Mar. 27, 1990

[54] FOLDABLE CARTON

[76] Inventor: James Bannister, R.R. 2, Oliver, British Columbia, V0H 1T0, Canada

[21] Appl. No.: 367,592

[22] Filed: Jun. 19, 1989

[51] Int. Cl.[4] ..... B65D 5/22

[52] U.S. Cl. ..... 229/143; 229/150; 229/178; 229/919; 229/DIG. 11

[58] Field of Search ..... 229/143, 149, 150, 151, 229/178, 915, 919, DIG. 11, 172, 173

[56] References Cited

U.S. PATENT DOCUMENTS

| | | | |
|---|---|---|---|
| 3,157,346 | 11/1964 | Hamilton | 229/915 |
| 3,756,499 | 9/1973 | Giebel et al. | 229/173 |
| 3,820,706 | 6/1974 | Gibson et al. | 229/172 |
| 3,973,723 | 8/1976 | Owens | 229/178 |
| 4,101,048 | 7/1978 | Riebon et al. | 229/919 |
| 4,151,948 | 5/1979 | de la Fuente, Jr. | 229/178 |
| 4,770,339 | 9/1988 | Weiner | 229/178 |

*Primary Examiner*—Gary Elkins
*Attorney, Agent, or Firm*—Fetherstonhaugh & Co.

[57] ABSTRACT

A foldable carton particularly useful for packaging produce. The carton includes a central panel and a pair of opposed exterior end panels and a pair of interior end panels affixed to the exterior end panels. A pair of supplementary interior end panels are affixed to each of the interior end panels and a supplementary interior end panel flap is affixed to each supplementary interior end panels. The carton has a pair of opposed side panels affixed to the central panel formed with a plurality of spaced apart side panel ventilation holes. A pair of side panel flaps are affixed to each end the side panels and a pair of opposed cover panels with ventilation holes are also affixed to the side panels. Forming the foldable carton involves folding the supplementary interior end panel flaps to overlie the supplementary interior end panels, folding the supplementary interior end panels to overlie the interior end panels and folding the side panel flaps to overlie each other. The interior end panels are then folded over the exterior end panel to enclose the supplementary interior end panel flaps, the supplementary interior end panels and the side panel flaps between the interior and exterior end panels to form a carton end wall construction that includes five overlapping layers sandwiched between the interior and exterior end panels.

10 Claims, 5 Drawing Sheets

FOLDABLE CARTON

FIELD OF THE INVENTION

The present invention relates to a foldable carton for use typically in the package and storage of fruit.

BACKGROUND OF THE INVENTION

Food items such as fruit, particularly soft fruits, enjoy only a limited life after being picked. For example, such fruits as peaches and plums may have a shelf life of only up to two weeks after being picked depending upon the temperature and other storage conditions. In order to maximize the life of such fruit during storage, it is essential to provide for air circulation through the fruit in its stored condition in order to maintain a cooling air flow over the fruit's surface and thereby help to inhibit the formation and heat build-up associated with bacteria.

Over the years various types of cartons have been used to store fruit in the fruit industry. Such cartons have exhibited problems of inadequate ventilation of the produce contained in these boxes together with inadequate strength and limited stackability due to not only limited strength but also the tendency of the cartons to slip one over the other. Also, it is desirable to dimension the cartons so that when they are positioned on a pallet they are compatible with the dimensions of the pallet. Some boxes in the fruit industry are dimensioned so that when they are stacked side by side and end to end they do not fit within the overall dimensions of a standard sized pallet so that stacking onto the pallet is relatively inefficient.

As a result of the foregoing problems the fruit industry began fabricating cardboard boxes using glue in order to realize greater strength through a more rigid structure as well as reduction in the amount of material used to make each carton. Because it is not practical to transport boxes once they are glued, it is necessary to carry out the gluing operations at the same location where the boxes are to be used. The need to locate the gluing operation adjacent the packaging operation has imposed a severe limitation on the acceptability of glued boxes other than for very large packing plant operations.

Prior art examples of cardboard containers that use glue or staples in their construction and are used for storage of assorted materials are shown in U.S. Pat. Nos. 2,950,850 to Corcoran and 2,572,610 to Gilbert.

Other foldable cardboard containers have been developed for storing fruit produce and other perishable materials that avoid the problems of gluing and stapling. These cartons rely on arrangements of interlocking tabs for their structural rigidity. Examples of such containers are disclosed in the following patents:

U.S. Pat. No. 1,894,226 to Ross
U.S. Pat. No. 2,105,057 to Sharpe
U.S. Pat. No. 2,811,298 to Jones
U.S. Pat. No. 3,108,569 to Kundikoff
U.S. Pat. No. 3,756,499 to Giebel
U.S. Pat. No. 3,973,723 to Owens
U.S. Pat. No. 3,820,706 to Gibson et al.
U.S. Pat. No. 4,101,048 to Rieben et al.
U.S. Pat. No. 4,304,353 to Stollberg
UK Patent No. 2,043,596 to Scotcher et al.
French Patent No 2240156
French Patent No. 2299226
French Patent No. 2363489; and Italian Patent No. 0678940

SUMMARY OF THE INVENTION

According to the present invention there is provided a foldable carton comprising:

a central panel;

a pair of opposed exterior end panels affixed to said central panel and foldable about respective central-end panel edges;

a pair of interior end panels affixed to said exterior end panels by and foldable about a top end edge;

a pair of supplementary interior end panels affixed to each of said interior end panels by and foldable about an interior end panel edge;

a supplementary interior end panel flap affixed to each of said supplementary interior end panels by and foldable about a supplementary flap edge;

a pair of opposed side panels affixed to said central panel and foldable about respective central-side panel edges having a plurality of spaced apart side panel ventilation holes therein;

a pair of side panel flaps affixed to each end of each of said side panels and foldable with respect thereto about respective flap edges;

a pair of opposed cover panels affixed to respective side panels and foldable about respective cover side panel edges and removably engageable with said end panels, said cover panels having cover ventilation holes along the cover side panel edges;

said interior end panel having means for removable locking engagement with said central panel upon being folded over said exterior end panel;

whereby forming said foldable carton includes folding said supplementary interior end panel flaps to overlie said supplementary interior end panels, folding said supplementary interior end panels to overlie said interior end panels, folding said side panel flaps to overlie each other, and folding said interior end panels over said exterior end panels about said top end edge to enclose said supplementary interior end panel flaps, said supplementary interior end panels and said side panel flaps between said interior and exterior end panels thereby forming a carton end wall construction that includes five overlapping layers sandwiched between said interior and exterior end panels.

It is the end wall construction comprising a total of seven separate layers of material that give the carton of the present invention a rigidity and stacking ability not found in the prior art patents. This rigidity is achieved by the compact folding arrangement of the supplementary end panel flaps and the supplementary end panels.

The foldable carton of the present invention can be formed with side panels that are inclined outwardly from the vertical. The provision of an inclined pair of outwardly extending side panels provides a plenum between two adjacent cartons stacked side by side which allows air to flow parallel to the side panels along a stacked array of such cartons.

Unlike prior art cartons, the design of the present carton is such that in its laid out or blank form it is substantially rectangular in shape. Thus, in dye-cutting such cartons from sheets of material, a minimum of waste is incurred. The carton, moreover, can be easily and securely assembled in a folded position without the need to use fasteners such as staples or other materials such as glue.

BRIEF DESCRIPTION OF THE DRAWINGS

Embodiments of the foldable carton are illustrated, merely by way of example, in the accompanying drawings in which.

DETAILED DESCRIPTION OF THE PREFERRED EMBODIMENTS

In the Figures of the various embodiments, like reference numbers refer to like parts. Moreover, in the following description, words such as "upper", "top", and "bottom" are used in a relative sense only and not in an absolute sense.

Figure 1:
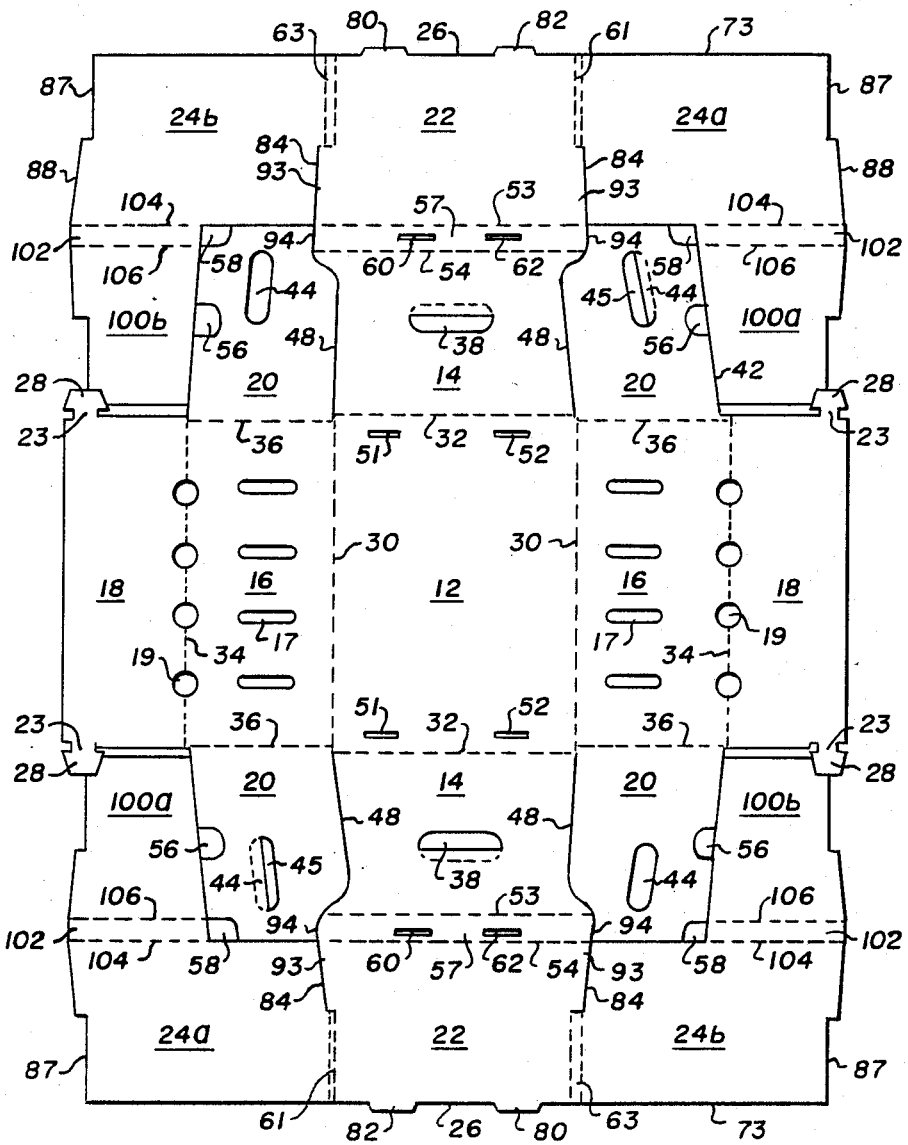
FIG. 1 is a plan view of a first embodiment of the carton having inclined sides in unfolded form.

A first embodiment of the carton 10 of the present invention is shown in FIG. 1 in unfolded form and includes a rectangular central panel 12 which forms the base of a folded carton. This central panel is joined by means of respective opposed central-side panel edges 30 to a pair of opposed rectangular side panels 16, and by respective opposed central-end panel edges 32 to a pair of opposed exterior end panels 14.

In all embodiments of the present invention, the carton material is typically made of corrugated cardboard or of some other suitable resilient material which permits one section of the carton to be folded relative to the other.

Affixed to each side panel 16 along a cover-side panel edge 34 is a cover panel 18. Perforated in each of the side panels 16 are a plurality of elongated spaced-apart ventilation holes 17 formed therein.

The cover panel 18 also has a plurality of spaced-apart ventilation holes 19 formed along the cover-side panel edge 34 in alignment with corresponding ventilation holes 17 on side panel 16. On either end of cover panel 18 there is a cover tab 28 projecting outwardly therefrom. Cover tab 28 is foldable about a cover tab folding edge 23. At either end of said panel 16 there are side panel flaps 20 foldable about a flap edge 36. Each of side panel flaps 20 has formed therein an elongated opening 44 which is located so as to overlap with handle cutout 38 in exterior end panel 14 when in a folded position. Flap 45 is formed in one elongated opening 44 of each pair of openings.

Side panels flaps 20 have top and bottom edges 42 and 48, respectively, that are at an angle with respect to central-side panel and cover-side panel edges 30 and 34, respectively. Preferably, side panel flaps 20 extend from side panels 16 at an angle of approximately four degrees with respect to central-side panel edge 30. Necessarily, exterior end panel 14 has inwardly converging edges that it shares with side panel flaps 20. Top edge 42 of side panels flaps 20 are formed with cutouts 56 and 58. Adjacent top end edge 57 of the interior end panel flap, the inwardly converging edges widen at 94 to join the top end edge. Adjacent the central-end panel edge 32 are a pair of spaced-apart central panel cutouts 51 and 52. Along top end edge 57, there are also two top end edge cutouts 60 and 62. Top end edge 57 is formed between two folding lines 53 and 54 adjacent to exterior end panel 14 and an interior end panel 22.

On the outer edge 26 of each interior end panel 22 are formed two spaced tabs 80 and 82. Interior end panel 22 has interior end panel edges 61 and 63 on either side thereof extending partially across the end panel. Each of edges 61 and 63 is formed between a pair of folding lines. Edge 63 is wider than edge 61. Interior end panel edges 61 and 63 merge into interior end panel side edges 84 that extend outwardly to form ears 93. Interior end panel side edges 84 are inclined to central-side planel edges 30 and are at substantially the same angle thereto as are flap bottom edges 48.

Attached to interior end panels 22 by means of interior end panel edges 61 and 63 are supplementary interior end panels 24a and 24b. The supplementary interior end panels 24a and 24b have edges 87 substantially perpendicular to panel contacting edges 73 and adjacent angled edges 88 formed at the same angle as corresponding interior end panel side edges 84.

Supplementary interior end panel flaps 100a and 100b are attached to supplementary interior end panel flaps 24a and 24b respectively along an outer portion of top edge 85 at supplementary flap edge 102. Flaps **100*a* and 100*b* are located adjacent side panel flaps 20 and extend toward cover panels 18. Like top end edge 57 and interior end panel edges 61 and 63, supplementary flap edges 102 have two fold lines 104 and 106 to render flap edge 102** sufficiently wide to accommodate folding of the cardboard carton.

Figure 2:
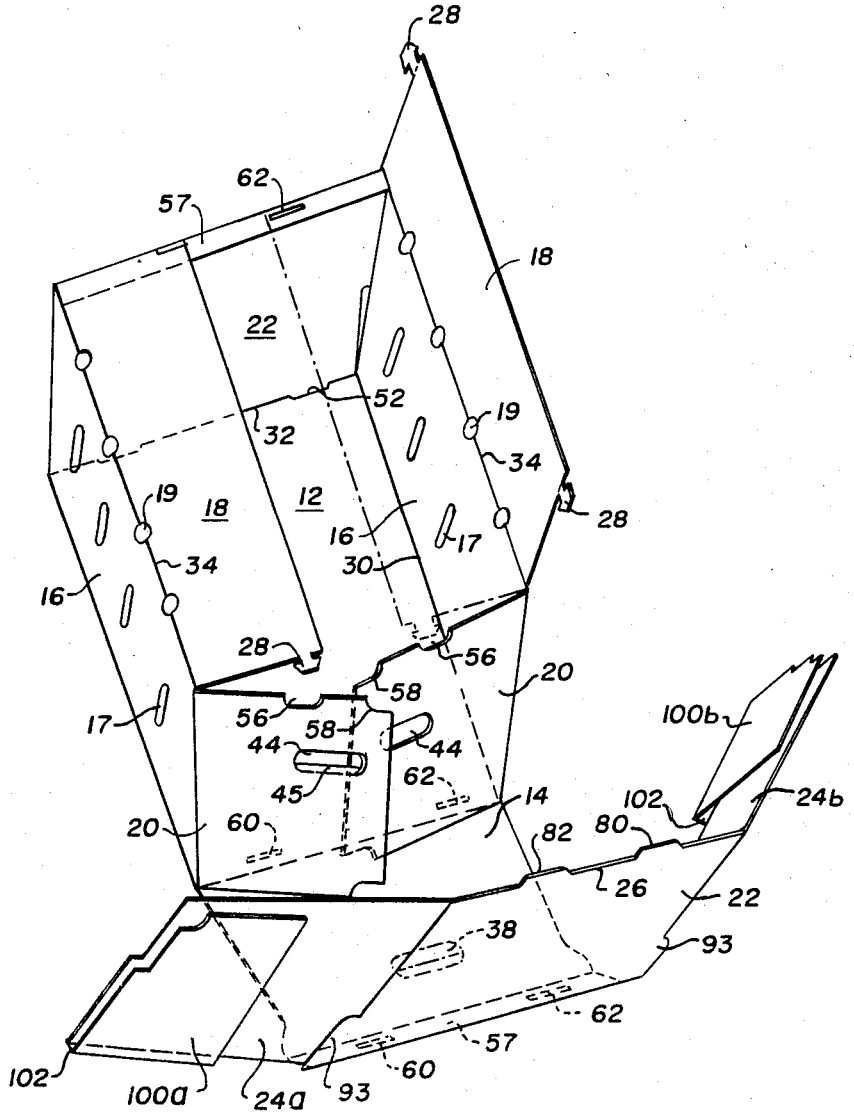
FIG. 2 is a perspective view of the carton of FIG. 1 showing how the end of the carton is folded.

In the following description of forming the blank of FIG. 1 into a carton reference should be made to FIG. 2. In forming a folded carton from the cutout illustrated in FIG. 1, side panel flaps 20 are folded inwardly about flap edges 36 and side panels 16 are folded about central-side panel edges 30 such that the side panel flaps overlie each other. In the embodiment of FIG. 1, side panels 16 are inclined at an angle slightly larger that ninety degrees to the plane of central panel 12 when side panel flap bottom edge 48 lies along central-end panel edge 32 due to the angled attachment of the side flaps to side panel 16. Flap 45 in one of the openings 44 is folded into the corresponding opening of the adjacent side panel flap 20 to lock the two side panel flaps together.

Supplementary interior end panel flap **100*a* is folded downwardly out of the plane of the sheet of FIG. 1 about flap edge 102 to overlie supplementary interior end panel 24*a*. Supplementary interior end panel flap 100*b* is folded upwardly out of the plane of the sheet of FIG. 1 about flap edge 102 to overlie supplementary interior end panel 24*b*. Supplementary interior end panels 24*a* is then folded about edge 61 to overlie interior end panel 22. Supplementary interior end panel 24*b* is folded about interior end panel edge 63 to lie flat against the previously folded supplementary interior end panel 24*a*. Edge 63 is widened to accommodate the extra thickness of material over which panel 24*b* must be folded. In this position, supplementary interior end panels 100*a* and 100*b* are sandwiched between supplementary end panels 24*a* and 24*b* atop interior end panel 22 and edge 102 of the flaps 100*a* and 100*b* are adjacent top end edge 57. The angled edge 88 of supplementary interior end panels 24*a* and 24*b* overlies and is substantially parallel to respective interior end panel side edge 84**.

Interior end panel 22 is folded about folding edges 53 and 54 over side panel flaps 20. Top end edge 57 is sufficiently wide to accommodate the side panel flaps, and the supplementary interior end panels and associated flaps over which edge 57 is folded.

On completion of the latter folding operation, tabs 80 and 82 are locked into central panel cutouts 51 and 52, respectively. Cover panels 18 are folded about cover side panel edge 34 and tab 28 is folded about cover tab edge 23 such that tab 28 enters into an associated top end edge cutout 60 and 62. Tabs 28 are retained in cutouts 56 and 58 in side panel flaps 20 which align beneath cutouts 60 and 62 when the carton is folded.

Figure 3:
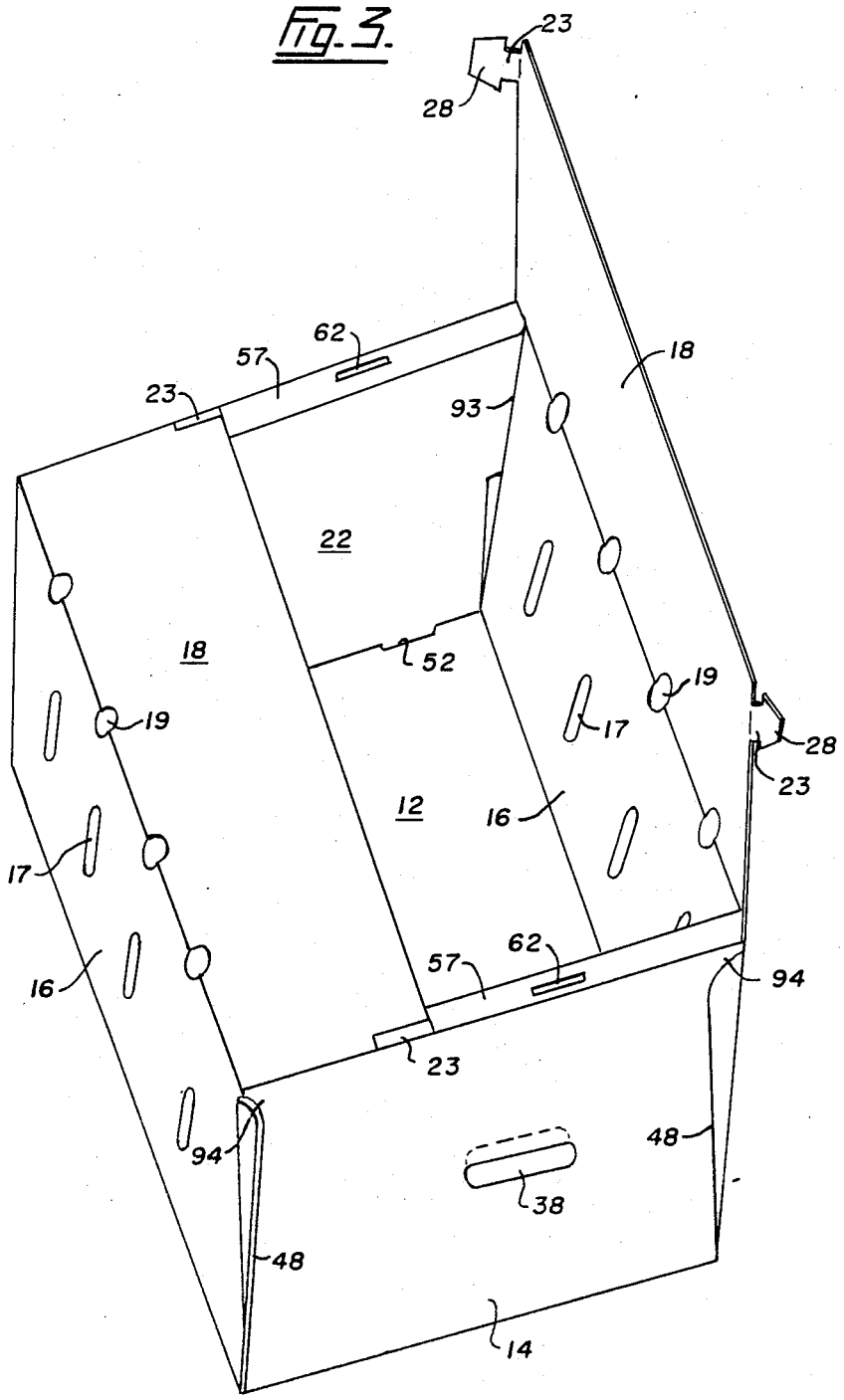
FIG. 3 is a perspective view of the carton of FIG. 1 in folded form with one cover panel opened.

The fully assembled carton of FIG. 1 is shown in FIG. 3. When in folded position, side panels 16 form a slight outwardly inclined angle from the perpendicular with respect to the vertical and the ventilation holes 17 are oriented substantially vertically in transverse alignment with corresponding associated ventilation holes 19. Preferably, the corrugations in the cardboard material are oriented to run parallel to central-side panel edges 30 providing maximum strength against compression in interior and exterior end panels 14 and 22.

With two cartons 10 side by side, the space between the side panels 16 of adjacent cartons 10 forms a plenum of triangular cross section running along the length of the carton 10 which permits air to run along the sides of the carton 10 and enter into the latter through elongated ventilation holes 17. Air then circulates through the contents contained in the carton 10 and exits out through cover panel ventilation holes 19. By arranging for the latter holes to be located directly above the side panel ventilation holes 17, exit holes are provided in the vertical path of air entering into the side panel ventilation holes that are not covered by the central panel 12 of an overlying stacked carton 10 as the outwardly inclined side panels make the top of the carton wider than the central panel 12.

Figure 4:
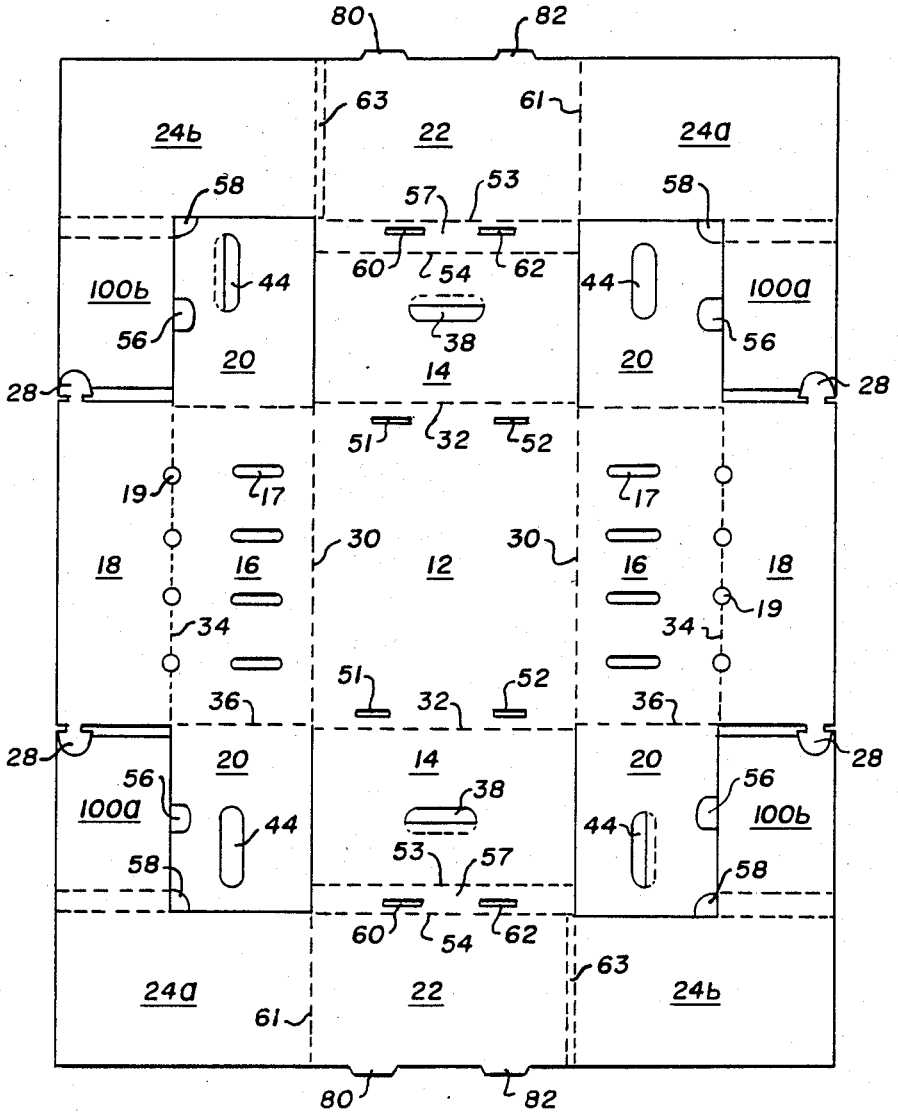
FIG. 4 is a plan view of a second embodiment of the carton having vertical sides in unfolded form.
Figure 5:
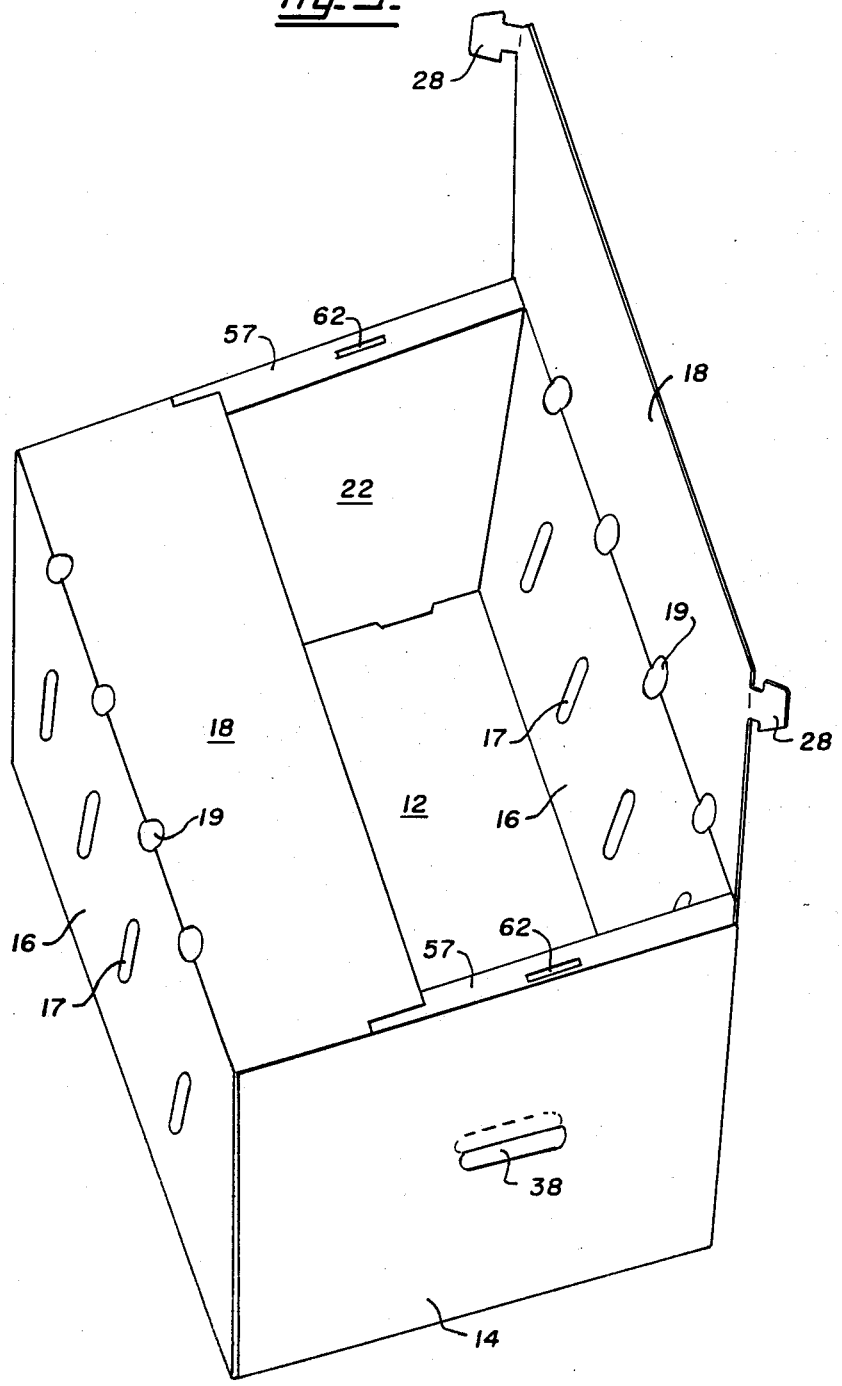
FIG. 5 is a perspective view of the carton of FIG. 4 in folded form.

While the embodiment of FIG. 1 has been shown with inclined side panels 16, it is understood that a similar carton can also be constructed having vertical sides. Such a carton is shown in FIGS. 4 and 5 in which side panel flaps 20 are formed with edges that extend parallel to central-side panel edge 30 and cover-side panel edge 34. In this second embodiment of the present invention, all parts which are analogous to the parts of the first embodiment are identically numbered.

Both embodiments of the present invention create a seven ply end wall construction resulting in an extremely rigid carton able to withstand heavy stacking loads.

In both embodiments of the present invention, cover panels 18 can be dimensioned so that they do not meet when they are folded into a covering position atop the carton. The gap left between the cover panels in such an arrangement defines a central ventilation opening for increasing cooling of the produce in the cartons.

Although the present invention has been described in some detail by way of example for purposes of clarity and understanding, it will be apparent that certain changes and modifications may be practiced within the scope of the appended claims.

I claim:

1. A foldable carton comprising:

a central panel;

a pair of opposed exterior end panels affixed to said central panel and foldable about respective central-end panel edges;

a pair of interior end panels affixed to said exterior end panels by and foldable about a top end edge;

a pair of supplementary interior end panels affixed to each of said interior end panels by and foldable about an interior end panel edge;

a supplementary interior end panel flap affixed to each of said supplementary interior end panels by and foldable about a supplementary flap edge;

a pair of opposed side panels affixed to said central panel and foldable about respective central-side panel edges having a plurality of spaced apart side panel ventilation holes therein;

a pair of side panel flaps affixed to each end of each of said side panels and foldable with respect thereto about respective flap edges;

a pair of opposed cover panels affixed to respective side panels and foldable about respective cover side panel edges and removably engageable with said end panels, said cover panels having cover ventilation holes along the cover side panel edges;

said interior end panel having means for removable locking engagement with said central panel upon being folded over said exterior end panels;

whereby forming said foldable carton includes folding said supplementary interior end panel flaps to overlie said supplementary interior end panels, folding said supplementary interior end panels to overlie said interior end panels, folding said side panel flaps to overlie each other, and folding said interior end panels over said exterior end panels about said top end edge to enclose said supplementary interior end panel flaps, said supplementary interior end panels and said side panel flaps between said interior and exterior end panels thereby forming a carton end wall construction that includes five overlapping layers sandwiched between said interior and exterior end panels.

2. A foldable carton as claimed in claim 1 in which said means for removable locking engagement with said central panel comprises a pair of spaced tabs formed along an outer edge of said interior end panel aligned with and insertable into a corresponding pair of spaced cutouts in said central panel proximate said central end panel edge upon folding of said interior end panel.

3. A foldable carton as claimed in claim 1 in which said carton is cut from corrugated cardboard with corrugations thereof running along the length of said central panel such that the corrugations of said end panels and said end panels flaps are substantially perpendicular to said central panel.

4. A foldable carton as claimed in claim 1 in which each of said cover panels has a cover tab on opposed ends foldable and insertable into corresponding top end edge cutouts.

5. A foldable carton as claimed in claim 4 in which said side panel flaps have cutouts in a top edge thereof alignable upon folding with corresponding top end edge cutouts to create a cavity for insertion of said cover tabs.

6. A foldable carton as claimed in claim 1 in which each of said side panels and cover panels has a plurality of spaced ventilation holes such that when folded the cover ventilation holes are aligned with said side panel ventilation holes along the length thereof and the latter holes are proximate the cover side panel edges.

7. A foldable carton as claimed in 6 in which said cover panels are dimensioned to extend only partially across the open top of said carton when folded thereby defining a central ventilation opening between said cover panels.

8. A foldable carton as claimed in claim 1 in which said side panel flaps have parallel top and bottom edges that extend from said side panels at an angle to said flap edge such that said side panels are inclined upwardly and outwardly from said central panel when said side panels are folded inwardly to overlie each other.

9. A foldable carton as claimed in claim 8 in which said side panel flaps extend from said side panels at an angle of approximately four degrees with respect to said central-side panel edges.

10. A foldable carton as claimed in claim 8 in which said exterior end panel has inwardly converging edges to accommodate said bottom edges of said side panel flaps extending from said bottom end panel edge to adjacent said top end edge where said inwardly converging edges widen to join said top end edge.

* * * * *